United States Patent [19]

Peckham

[11] Patent Number: 4,963,843

[45] Date of Patent: Oct. 16, 1990

[54] STRIPLINE FILTER WITH COMBLINE RESONATORS

[75] Inventor: David S. Peckham, Barrington Hills, Ill.

[73] Assignee: Motorola, Inc., Schaumburg, Ill.

[21] Appl. No.: 265,151

[22] Filed: Oct. 31, 1988

[51] Int. Cl.[5] ..... H01P 1/203; H01P 1/205

[52] U.S. Cl. ..... 333/203; 333/204

[58] Field of Search ..... 333/203–205, 333/219

[56] References Cited

U.S. PATENT DOCUMENTS

| | | | |
|---|---|---|---|
| Re. 31,470 | 12/1983 | Bedard et al. | 333/204 |
| 3,451,015 | 6/1969 | Heath | 333/203 |
| 3,579,152 | 5/1971 | Moore | 333/203 |
| 4,157,517 | 6/1979 | Kneisel et al. | 333/205 |
| 4,418,324 | 11/1983 | Higgins | 333/204 |
| 4,488,130 | 12/1984 | Young et al. | 333/204 X |
| 4,551,696 | 11/1985 | Moutrie et al. | 333/204 |
| 4,609,892 | 9/1986 | Higgins, Jr. | 333/204 |

FOREIGN PATENT DOCUMENTS

| | | | |
|---|---|---|---|
| 30403 | 2/1987 | Japan | 333/204 |
| 43902 | 2/1987 | Japan | 333/204 |

*Primary Examiner*—Eugene R. LaRoche
*Assistant Examiner*—Benny T. Lee
*Attorney, Agent, or Firm*—Rolland R. Hackbart

[57] ABSTRACT

A combline stripline filter includes a number of conductive strips, each connected to ground on one end and capacitively loaded to ground at the other end. Input and output pads will make a surface mountable connection to a printed circuit board. Tuning is provided for by removing ground over the extension ends of the outside resonators. The center resonators are tuned by removing metal from areas on the cover that are connected to the resonators by plated through holes. Undesired capacitance is compensated for by rounding the ends of the resonators and the opposing ground planes.

8 Claims, 2 Drawing Sheets

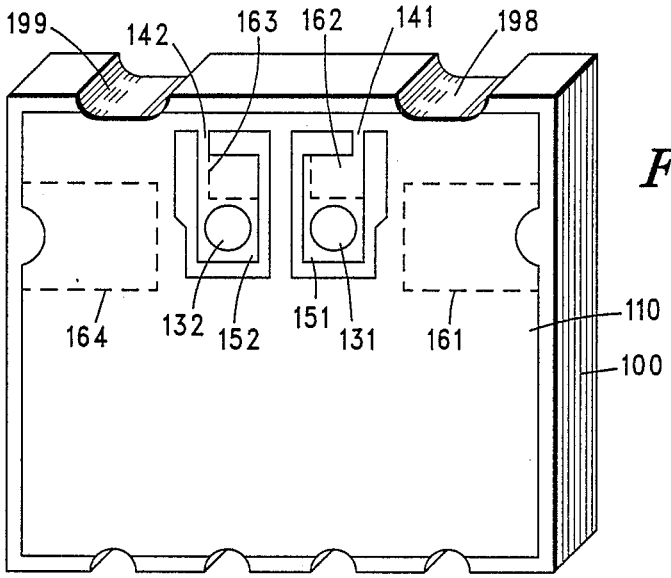
FIG.1A
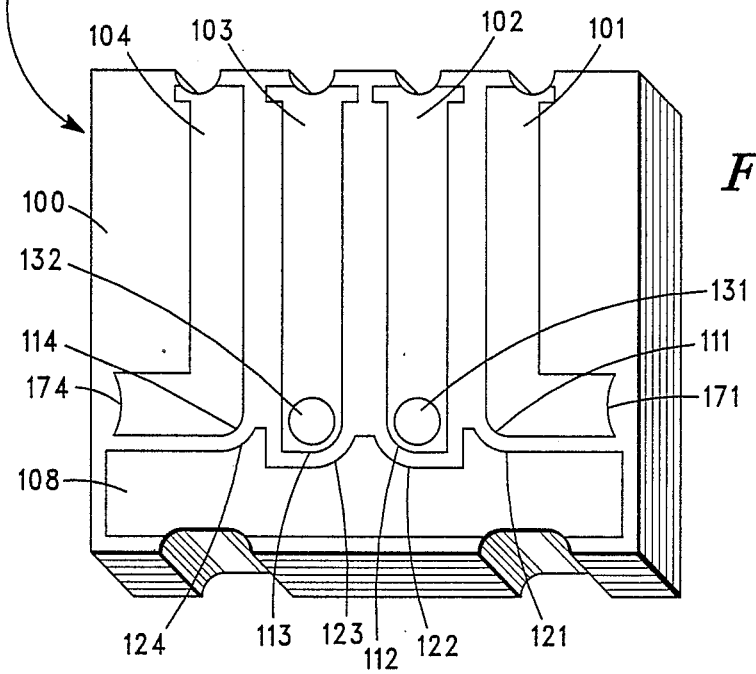
FIG.1B
FIG.3
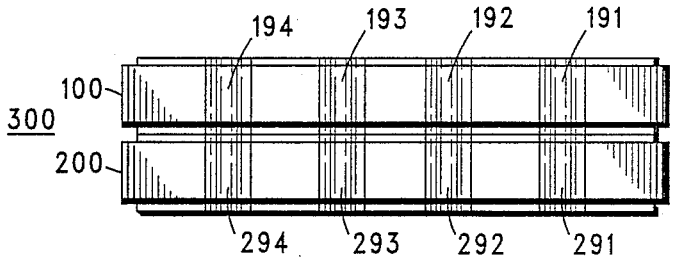

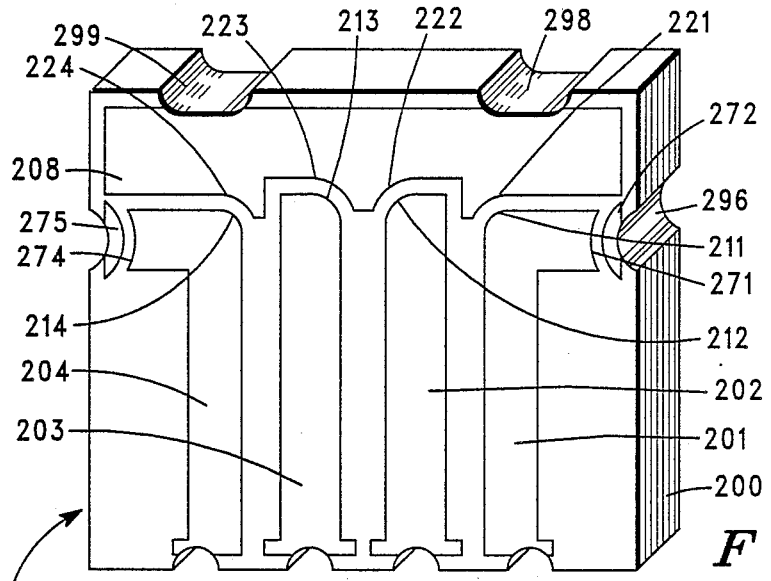
FIG. 2A
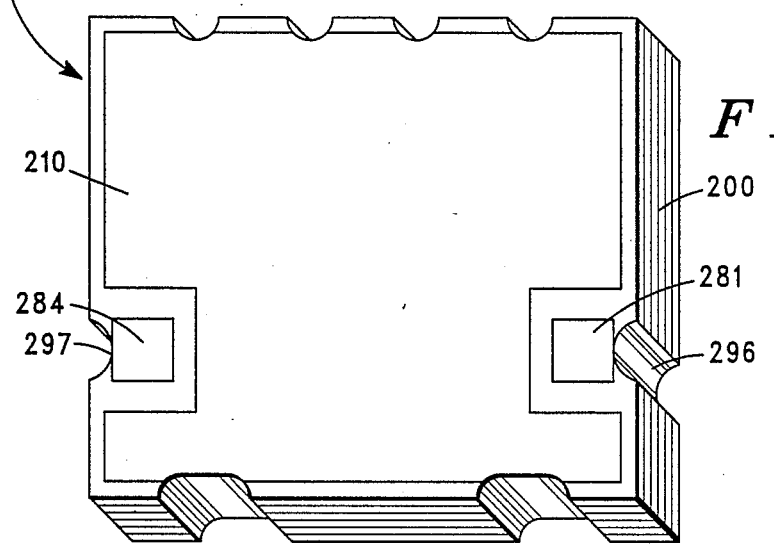
FIG. 2B
FIG. 4
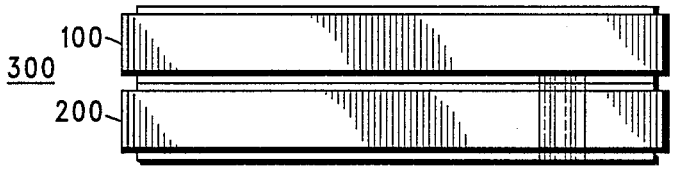

STRIPLINE FILTER WITH COMBLINE RESONATORS

BACKGROUND OF THE INVENTION

The present invention is generally related to stripline filters and more particularly to an improved stripline filter with combline resonators having a transmission zero above the passband.

In the field of portable communication equipment, size and cost are of great concern. Also in many applications, insertion loss must be minimized while maximizing out-of-band attenuation.

Surface acoustic wave (SAW) filters have been used to fill this need because of their small size and good out-of-band attenuation. However, the SAW filter generally requires external matching circuitry eliminating its size advantage, insertion loss tends to be higher than other filters, and the cost is higher than stripline filters.

The coaxial resonator filter will have low passband loss and good attenuation, but will generally be too large to use in portable applications where low loss is not absolutely critical.

Microstrip transmission line filters such as that described in U.S. Pat. No. 4,551,696 have been used in portable applications providing adequate performance at low cost. However a microstrip filter requires more board area than a stripline filter, may have cover detuning problems, and is subject to possible radiation problems.

The interdigital stripline filter such as those described in U.S. Pat. Nos. 4,157,517, 4,418,324, RE31,470, and 4,609,892 has been frequently used in portable applications and provides adequate performance at a reasonable size and cost. However, when selectivity requirements in portable applications are stringent, the number of poles in such interdigital stripline filters may become excessive. In such case, the combline stripline filter has the advantage of an additional zero above the passband, so will generally require one less pole. One less pole will mean less insertion loss and less area. A further slight size advantage is gained in that the combline stripline filter will generally have closer resonator spacings for the same bandwidth filter than the interdigital stripline filter. However, combline stripline filter currently available do not realize these advantages due to difficulties in implementing the required capacitances while avoiding undesirable stray capacitive coupling.

OBJECTS OF THE INVENTION

Accordingly, it is an object of the present invention to provide an improved combline filter in stripline form with maximum selectivity in a minimum area.

It is another object of the present invention to provide an improved combline stripline filter with capacitance at the ends of the resonators that will not affect the electrical length or coupling of the resonators.

It is a further object of the present invention to provide a means of tuning the resonators of an improved combline stripline filter with enough tuning range to compensate for manufacturing tolerances.

BRIEF DESCRIPTION OF THE DRAWINGS

FIGS. 1A and 1B show the cover substrate of a combline stripeline filter embodying the present invention, where FIG. 1A shows the outside ground and trim pattern thereof, and FIG. 1B shows the inside resonator pattern thereof.

FIGS. 2A and 2B show the base substrate of a combline stripline filter embodying the present invention, where FIG. 2A shows the inside resonator pattern (which matches the inside resonator pattern of the cover resonator in FIG. 1A), and FIG. 2B shows the outside ground and input pattern thereof.

FIG. 3 is an edge view of the cover and base substrates in FIGS. 1A, 1B and 2A, 2B showing the ground end of the resonators.

FIG. 4 is an edge view of the cover and base substrates in FIGS. 1A, 1B and 2A, 2B showing the right input side.

DESCRIPTION OF THE PREFERRED EMBODIMENT

A typical transmitter for duplex radios will many times mix two local oscillator signals to produce the transmit signal. This requires a filter to select the desired mixing product and filter out noise in the receive band. Depending on the frequency separation and the selectivity required in such duplex radios, the present invention may readily be utilized in meeting these requirements. Moreover, the present invention will find further advantage in applications where size and cost requirements are stringent.

In FIGS. 1A, 1B, 2A and 2B, there is illustrated a preferred embodiment of a combine stripline filter 300 of the present invention comprised of a base substrate 200 and a cover substrate 100 such preferably comprised of material such as a high dielectric neodymium. In constructing filter 300, the two resonator patterns in FIGS. 1B and 2A are bonded together as shown in FIGS. 3 and 4, preferably by soldering, to form four conductive strips 101/201, 102/202, 103/203, 104/204 sandwiched between two ground planes 110 and 210 by high dielectric material. The conductive strips are commonly referred to as resonators.

The input/output pads 281 and 284 of filter 300 are connected to the center layer input/output pads 272 and 275 by plated through half holes 296 and 297 (see FIG. 4), respectively. Input and output signals coupled to input/output pads 281 and 284 are capacitively coupled to the sides extensions 271 and 274 of the outside resonators 101/201 and 104/204 both by input/output pads 281 and 284 through the base substrate and by edge fringing capacitance from input/output pads 272 and 275.

The resonating frequency of outside resonators 101/201 and 104/204 of filter 300 is determined by three factors. First, for a given dielectric constant and spacing from ground planes 110 and 210, the frequency is raised by decreasing the length of the resonators 101/201 and 104/204. Second, the resonating frequency can also be raised by decreasing the characteristic impedance of resonators 101/201 and 104/204 by making them wider. Third, the resonating frequency is increased by decreasing the capacitance between the free end of the resonators and ground. This accomplished by either decreasing the area of the end edges of the side extensions 171/271 and 174/274 of the resonators or increasing the gap between the upper edges 111/211 and 114/214 of the side extensions of the resonators and the inside ground planes 108/208. Another way to decrease capacitance of the resonators, which is a unique feature of this invention, is to remove metal from the trim area 161 and 164 of the ground plane 110 over the side extensions 171/271 and 174/274 of the resonators.

The frequency of the center resonators 102/202 and 103/203 of filter 300 is also determined by length, capacitance, and characteristic impedance. The length and characteristic impedance of the center resonators 102/202 and 103/203 vary in the same way as described hereinabove for the outside resonators 101/201 and 104/204. However, the capacitance of the center resonators is realized in a different manner than that of the outside resonators. Holes 131 and 132 plated or filled with conductive material are provided in the cover substrate 100 and couple to areas 151 and 152, respectively, which are grounded by shorting bars 141 and 142 on the cover, so the adjacent resonators can be tuned to a predetermined frequency. The shorting bars 141 and 142 are then cut at the appropriate time for center resonator tuning to complete the filter. The resonating frequency of the center resonators can be increased by increasing the gaps to ground between resonator edges 112/212 and 113/213 and ground plane edges 122/222 and 123/223, respectively. The resonating frequency can also be increased by a feature of the present invention wherein metal is removed from the areas 162 and 163 on the cover 100 connected to the center resonators 102/202 and 103/203 by plated holes 132 and 133, respectively. Trimming areas 162 and 163 provides much more tuning range in the center resonators than would be possible simply by trimming ground over or around a resonator.

Filter 300 is preferably tuned to the center frequency (e.g. 888 mHz) of a desired radio frequency passband (e.g. 872 mHz–905 mHz) by trimming the conductive material from dashed areas 161–164. Tuning is started beginning either with resonator 101/201 or 104/204. Starting with resonator 101/201, conductive material is removed from area 161 until a minimum return loss is obtained a the center frequency (typically 888 MHz). Then, the shorting bar 141 is removed. Next, resonator 102/202 is tuned by removing conductive material from area 162 until the return loss is centered at the center frequency. Then, resonator 104/204 is likewise tuned by removing conductive material from area 164 until the return loss is centered at the center frequency. Next, the shorting bar 142 is removed. Lastly, resonator 103/203 is tuned by removing conductive material from area 163 until the loss from input pad 181 to output pad 184 at a frequency in the stopband (917 MHz) is at least 20 dB.

Referring to FIG. 3, all resonators of filter 300 are connected on one end to the outside base ground plane 210 by means of plated through half holes 291, 292, 293, 294 and to the outside cover ground plane 110 by plated through half holes 191, 192, 193, 194. The base and cover ground planes 210 and 110 are further connected to inside ground planes 208 and 108 by plated through half slots 198, 199 and 298, 299, respectively, which are used to increase the capacitance of the free ends of the resonators.

The four conductive strips 101/201, 102/202, 103/203, 104/204 of filter 300 operate as transmission line resonators to form a four-pole bandpass filter. The inter-resonator coupling is primarily controlled by the spacing between the strips 101/201, 102/202, 103/203 and 104/204, and the electrical length of the strips. As the spacing between strips is decreased, the coupling, and therefore bandwidth will increase. At the frequency where the coupled electrical length is 90 degrees, there will be a zero or stopband. In most applications, the length of the resonators is generally set to around 75 degrees so the zero will increase attenuation at frequencies above the passband.

One of the problems with multiple resonator combline filters, which is compounded when the filter becomes more compact is undesired capacitive coupling between the free ends of the resonators. This coupling will tend to cancel the desired inductive coupling between resonators, thereby reducing the bandwidth. This problem may be compensated for by decreasing the resonator length, but this would then require more capacitance to ground. It could also be compensated for by decreasing the resonator spacing, but this would further increase the undesired capacitive coupling. According to a further feature of the present invention, the normally square corners of the free ends of the resonators of filter 300 are rounded or angled to reduce the capacitive coupling between them. By using this feature of the present invention, the unavoidable extra capacitive coupling due to such things as the feedthrough holes 131 and 132 may be substantially cancelled. In the preferred embodiment, the edges 111/211, 112/212, 113/213, 114/214 of the free ends of the resonators of filter 300 have been rounded and the opposing edges 121/221, 122/222, 123/223, 124/224 of the inside ground areas 108 and 208 have also been rounded and extended partially between the free ends of the resonators to further reduce capacitive coupling between resonators. Although the edges have been rounded, the edges may alternatively be angled or implemented by a diagonal cut or series of cuts in practicing the present invention.

In summary, an improved combline stripline filter 300 has been described. The improved filter 100/200 has been implemented in a high dielectric stripline form with its improved selectivity without sacrificing size or insertion loss. A unique way has been presented to implement the required filter capacitances, while allowing for inexpensive laser trimming, and compensating for undesired capacitive coupling.

I claim:

1. A stripline filter for filtering a radio signal from a signal source, comprising:

a substrate having top and bottom surfaces, each surface with a conductive material thereon forming a respective ground plane, and said substrate further having an inner circuitry layer including:

a ground area comprised of a conductive material, having a plurality of angled edges, and coupled to at least one of said ground planes; and at least two combline resonators, each resonator being comprised of a strip of conductive material, said strips being substantially parallel to one another, each strip having adjacent first ends coupled to at least one of said ground planes and having adjacent second ends capacitively coupled to said ground area, each of said adjacent second ends further having at least one angled edge disposed opposite a corresponding angled edge of said ground area, said strips each further having a respective extension portion at said second ends disposed substantially at right angles to said parallel strips, said extension portions each further having a respective edge disposed opposite and capacitively coupled to said ground area, and one of said extension portions being coupled to the radio signal.

2. The stripline filter according to claim 1, wherein at least one of said ground planes further includes two conductive input/output pads, each pad being capacitively coupled to and surrounded by the rest of said at least one of said ground planes and disposed substantially opposite and capacitively coupled to the second end of a corresponding strip.

3. A stripline filter for filtering a radio signal from a signal source, comprising:

a substrate having top and bottom surfaces, each surface with a conductive material thereon forming a ground plane, and said substrate further having an inner circuitry layer including:

grounded electrode means comprised of a conductive material, and coupled to at least one of said ground planes;

at least four combline resonators including two inside and two outside resonators, said resonators being comprised of strips of conductive material that are substantially parallel to one another, each strip having adjacent first ends coupled to at least one of said ground planes and having adjacent second ends capacitively coupled to said grounded electrode means, and the two outside strips each further having a respective extension portion at said second ends disposed substantially at right angles to said strips and extending away from the two inside strips, said extension portions each further having a respective edge disposed opposite and capacitively coupled to said grounded electrode means, and one of said extension portions being coupled to the radio signal; and at least one of said ground planes further including first and second portions, said portion being capacitively coupled to and surrounded by the rest of said at least one of said ground planes and disposed substantially opposite and electrically coupled to corresponding ones of the two inside strips.

4. The stripline filter according to claim 3, wherein at least one of said ground planes further includes two conductive input/output pads, each pad being capacitively coupled to and surrounded by the rest of said at least one of said ground planes and disposed substantially opposite and capacitively coupled to the second end of corresponding ones of the two outside strips.

5. The stripline filter according to claim 3, wherein the two inside strips each are electrically coupled to a corresponding one of said first and second portions of said at least one of said ground planes by conductive material in holes in said substrate.

6. A stripline filter for filtering a radio signal from a signal source, comprising:

a substrate having top and bottom surfaces, each surface with a conductive material thereon forming a ground plane, and said substrate further having an inner circuitry layer including:

grounded electrode means comprised of a conductive material, having a plurality of angled edges, and coupled to at least one of said ground planes; and at least three combline resonators including a center and two outside resonators, said resonators being comprised of strips of conductive material that are substantially parallel to one another, each strip having adjacent first ends coupled to at least one of said ground planes and having adjacent second ends capacitively coupled to said grounded electrode means, and each of said adjacent second ends further having at least one angled edge disposed opposite a corresponding angled edge of said grounded electrode means, said two outside strips each further having a respective extension portion at said second ends disposed substantially at right angles to said parallel strip, said extension portions each further having a respective edge disposed opposite and capacitively coupled to said grounded electrode means, and one of said extension portions being coupled to the radio signal.

7. The stripline filter according to claim 6, wherein at least one of said ground planes further includes at least one portion, said portion being capacitively coupled to and surrounded by the rest of said at least one of said ground planes and disposed substantially opposite and electrically coupled to the second end of said center strip.

8. The stripline filter according to claim 6, wherein at least one of said ground planes further includes two conductive input/output pads, each pad being capacitively coupled to and surrounded by the rest of said at least one of said ground planes and disposed substantially opposite and capacitively coupled to the second end of corresponding ones of the two outside strips.

* * * * *